US007225954B2

(12) United States Patent
Kubacki

(10) Patent No.: US 7,225,954 B2
(45) **Date of Patent: *Jun. 5, 2007**

(54) BEADED THIN WALL LARGE AEROSOL CONTAINER

(76) Inventor: Edward F. Kubacki, 2914 Deerpass Rd., Marengo, IL (US) 60152

( * ) Notice: Subject to any disclaimer, the term of this patent is extended or adjusted under 35 U.S.C. 154(b) by 540 days.

This patent is subject to a terminal disclaimer.

(21) Appl. No.: 10/863,024

(22) Filed: Jun. 8, 2004

(65) Prior Publication Data

US 2004/0217135 A1 Nov. 4, 2004

Related U.S. Application Data

(63) Continuation-in-part of application No. 10/238,286, filed on Sep. 10, 2002, now Pat. No. 6,786,370.

(51) Int. Cl.
*B65D 83/14* (2006.01)

(52) U.S. Cl. ..... 222/635; 222/1; 222/402.1; 220/672; 220/669

(58) Field of Classification Search ..... 222/402.1, 222/1, 635, 394; 220/669, 672
See application file for complete search history.

(56) References Cited

U.S. PATENT DOCUMENTS

| | | | | |
|---|---|---|---|---|
| 5,211,317 | A * | 5/1993 | Diamond et al. | 222/394 |
| 5,339,977 | A * | 8/1994 | Schormair et al. | 220/789 |
| 5,518,151 | A * | 5/1996 | Knickerbocker | 222/382 |
| 5,878,906 | A * | 3/1999 | Bolton et al. | 220/309.1 |
| 6,318,583 | B1 * | 11/2001 | Owens | 220/672 |
| 6,786,370 | B1 * | 9/2004 | Kubacki | 222/635 |

* cited by examiner

*Primary Examiner*—Frederick C. Nicolas
(74) *Attorney, Agent, or Firm*—Polster, Lieder, Woodruff & Lucchesi, L.C.

(57) ABSTRACT

A large size aerosol container (10') dispensing a fluent material. A generally cylindrical can body (12') is fabricated from a steel sheet and has a relatively thin sidewall thickness of between 0.004 inches and 0.010 inches depending upon the weight of the steel sheet from which the container is made. The can body has beads (30) formed at regular intervals substantially its length. The beading adds structural strength to the container so the container is not damaged by handling during manufacture of the container, will not collapse during vacuum filling, and cannot be crushed by hand before the container is filled. The container can withstand a vacuum of at least 23 inches of Mercury without collapsing. A valve assembly (14') includes a spray valve (20) for dispensing the fluent material stored in the container. The container is filled with the fluent material and a propellant stored in the container under pressure.

21 Claims, 2 Drawing Sheets

BEADED THIN WALL LARGE AEROSOL CONTAINER

CROSS REFERENCE TO RELATED APPLICATIONS

This application is a continuation-in-part of U.S. patent application Ser. No. 10/238,286, filed Sep. 10, 2002 now U.S. Pat. No. 6,786,370.

STATEMENT REGARDING FEDERALLY SPONSORED RESEARCH OR DEVELOPMENT

Not applicable

BACKGROUND OF THE INVENTION

This invention relates to aerosol containers, and more particularly to a 2 piece or 3 piece thin walled, non-barrier type aerosol container.

Thin wall, non-barrier type, aerosol containers are known in the art. See, for example, U.S. Pat. No. 5,211,317 to Diamond et al., and its reissue Re 35,843. It is a feature of containers built in accordance with the teachings of these patents that the sidewall of the container has a relatively thin thickness. In the Diamond et al. patent and its reissue, the container wall thickness is said to be on the order of 0.004-0.005 inches (0.102 mm-0.127 mm).

In un-pressurized containers, it is often possible to distort the sidewall of the container. The Diamond et al. patents, for example, refer to the sidewall being deflected by as much as ¼ inch, if a force of as little as 5-10 pounds is applied to the can prior to filling. Additionally, the can, when empty, is said to be easily crushable by hand pressure. However, the cans can be pressurized in a manner so that at 130° F. (54.4° C.), for example, the pressure does not exceed 120-130 psig. Further, the cans will not burst at one and one-half times this pressure (180 psig). However, the cans cannot be vacuum filled at a vacuum level greater than 18 inches of Mercury because if they are, the container will collapse.

While there are a number of advantages to a container having thin sidewalls (lower material costs, for example), current thin wall can constructions have drawbacks as well. For example, during handling of the container prior to its being filled, even a moderate amount of force can distort or crush the container. This renders the container unusable and adds to the manufacturing cost. Those skilled in the art will appreciate that moderate amounts of force can be inadvertently applied to the container at any of a number of different points during the handling and manufacture process, even though the process is substantially automated.

There is a further problem with larger size containers such as are used for insecticides, wasp and hornet sprays, household starch, household products, etc. Examples of these larger size containers are those referred to in the industry as a 211×612, 211×713, 211×804, 214×714, and 214×804 size containers. These containers are made from steel sheets weighing from eighty to eighty-five pounds (80-85 Lbs) per base box. Smaller size aerosol containers are, for example, made from a steel sheet weighing approximately seventy-three to seventy-five pounds (73-75 Lbs) per base box. Since the steel sheets are all of the same size, the heavier sheets are thicker than the lighter weight sheets. Use of a thicker sheet is necessary to prevent damage to the container caused by handling during manufacture of the container, container collapse during vacuum filling, and crushing by hand before the container is filled. The larger cans are more susceptible to damage not only because they are heavy, but also they have significantly greater exposed area to which unwanted and/or unintended forces can be applied.

It would be advantageous therefore to provide a thin wall aerosol container; however, one which, when unfilled, is not easily distorted and rendered unusable. The container will, when filled, withstand substantial forces without distorting, and meets Department of Transportation (DOT) standards in this regard.

BRIEF SUMMARY OF THE INVENTION

Among the objects of the invention, briefly stated, is a thin wall aerosol container for use in dispensing a fluent material. The container is either of a 2-piece or 3-piece construction, and is either a barrier or non-barrier type container. The container includes a cylindrical can body having a beaded construction. The beading adds significant structural strength to the container and prevents distortion or crushing of the container sidewall when the can is un-pressurized. The container also includes a spray valve assembly for dispensing the fluent material. Because of the increased structural strength created by the beading, the container is not subject to damage during manufacture, while still allowing the manufacturer to realize the savings of a thinner wall construction. For larger size containers, the beaded construction of the invention is advantageous in that the container sidewall can now be significantly thinner, thus providing substantial savings in material; while, preventing damage to the container as referred to above.

The can is filled both with the fluent material and a propellant. During filling, the container can withstand a vacuum of at least 23 inches of Mercury without collapsing. This allows the can body to be vacuum crimped to the spray valve assembly, simplifying the filling process.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings and which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
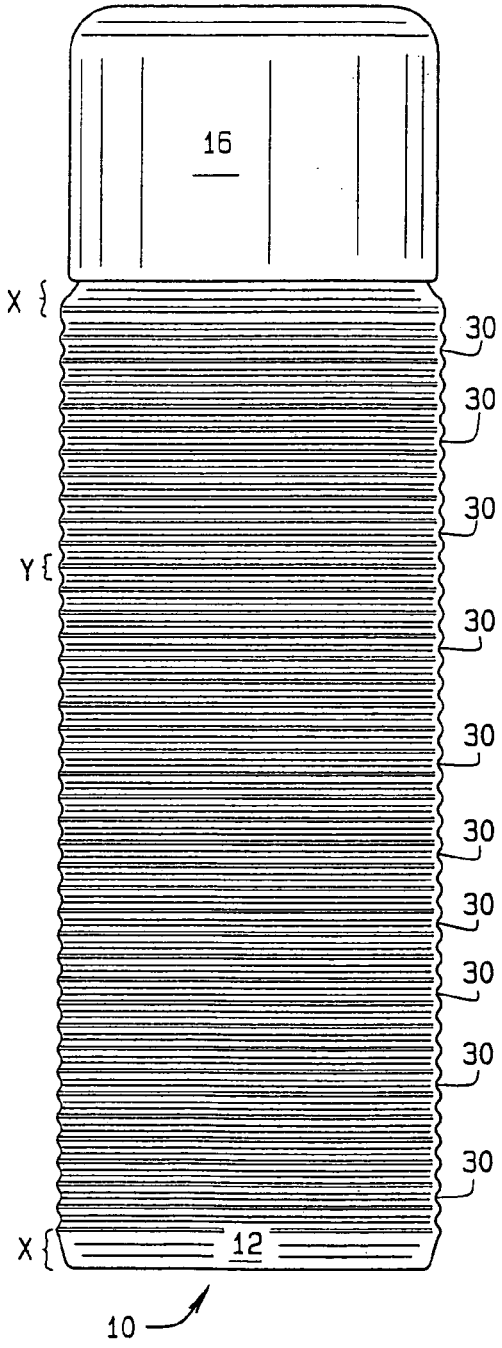
FIG. 1 is an elevation view of a container of the present invention.
Figure 2:
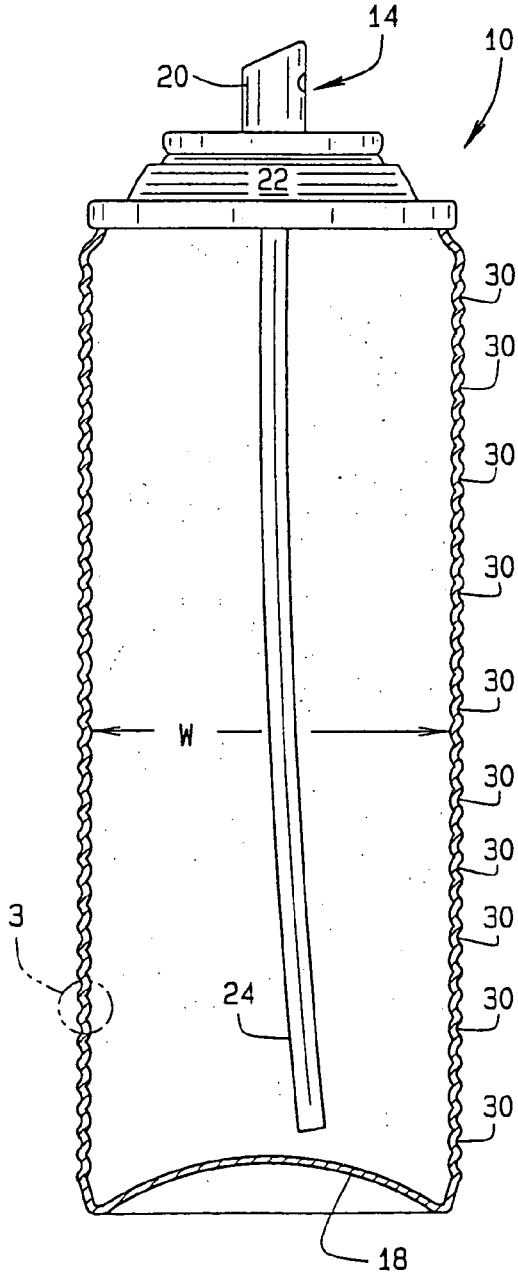
FIG. 2 is a partial sectional view of a 2-piece thin wall aerosol container.

Referring to the drawings, an aerosol container of the present invention is indicated generally 10 in FIGS. 1 and 2. In FIG. 2, the container is shown to be a non-barrier type container (that is, it has no wall separating the fluent material discharged from the container with a propellant used for this purpose); although the container could be a barrier type container without departing from the scope of the invention. Container 10 includes a can body 12, a valve assembly 14 for dispensing the fluent material stored in the container, and a cap 16.

Can body 12 comprises a generally cylindrical can body which having a relatively thin sidewall thickness. Preferably, can body 12 is made either of steel or aluminum. If the can body is made of steel, the wall thickness is between 0.004 and 0.008 inches (0.102-0.205 mm). If made of aluminum, the wall thickness is between 0.004 and 0.010 inches (0.102-0.255 mm). It will be appreciated by those skilled in the art, that aerosol containers are manufactured in standard sizes. Can body 12 is available in all of these standard sizes, and custom size containers can be manufactured as well.

Figure 4:
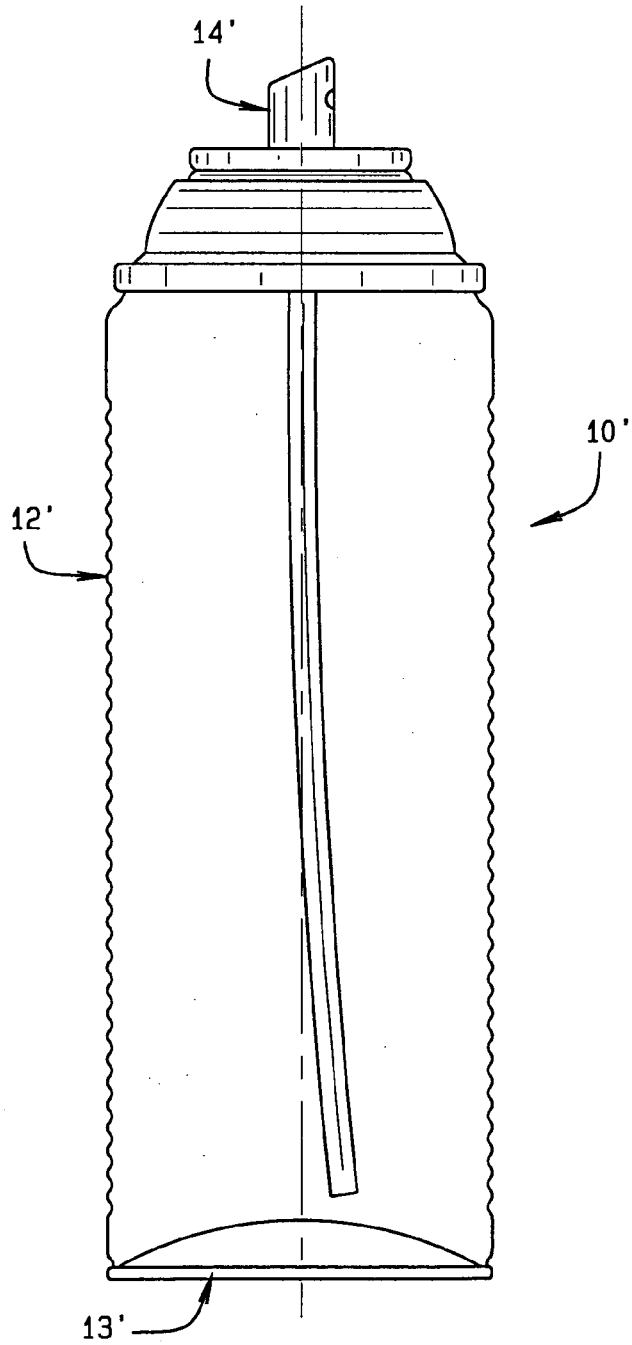

For purposes of this application, "large" size containers are 211×612, 211×713, 211×804, 214×714, 214×804, and similarly sized containers. Containers of these sizes are conventionally made using an 80 lb per base box steel sheet and would have a sidewall thickness of 0.0088 inches (0.223 mm). If made using an 85 lb per base box steel sheet, the container would have a sidewall thickness of 0.00935 inches (0.237 mm). These larger aerosol containers are typically 3-piece containers such as the container 10' shown in the FIG. 4. Container 10' includes a can body 12', a dome shaped base 13', a valve assembly 14' for dispensing fluent material stored in the container, and a cap (not shown) which fits over the valve assembly.

Using the beaded construction of the present invention, as shown in FIG. 1, a large container 10 or 10' can now be made with a wall thickness of between 0.004 and 0.010 inches (0.102-0.255 mm). This means that sheet steel in the weight range of fifty to fifty-five pounds (50-55 lbs) per base box could now be used for making the larger containers, substantially decreasing the material cost for the container while not making the container susceptible to the types of damage as previously discussed.

The can body includes a dome shaped base 18 forming the bottom of the can. Base 18 is made of the same material as body 12. In a two-piece container construction, either base 18 or a dome 22 is integrally formed with the can body. In a three-piece container construction, the base and dome are separate pieces which are attached to the respective lower or upper ends of the can body in the conventional manner. Valve assembly 14 includes a spray nozzle 20 of conventional design. The nozzle is mounted in the dome 22 forming the top of the can. A hollow dip tube 24 extends from nozzle 20 down into the lower reaches of the aerosol container as shown in FIG. 2. Fluent material flows through the dip tube to the spray nozzle when discharged from the container. When the container is not in use, cap 16 is fitted over the nozzle portion of the container. The propellant used to dispense the fluent material is a compressed gas for which the container pressure is between 90-140 psig (621-965 kPa) when the container is filled. Alternately, the propellant is a liquefied gas with the container pressure being between 30-50 psia (207-345 kPa) when the container is filled.

Unlike conventional thin wall aerosol containers, can body 12 of container 10 is a beaded can body. Preferably, the can has a series of spaced beads 30 formed at intervals along the length of the can body. As indicated in FIG. 1, the uppermost and lowermost beads are formed a predetermined distance X from the respective top and bottom of the can body. This distance is, for example, 0.75 inches (191 mm) for a two-piece container construction. Next, the beads are spaced so the center of each bead is a predetermined distance Y from the center of the adjacent bead. This distance is, for example, 0.125 inches (31.8 mm). The spacing is uniform along the length of the can. Each bead extends circumferentially about the can body and has a maximum depth or inward depression of Z which occurs substantially at the center of the bead. Depth Z is, for example, 0.021 inches (5.3 mm). As described herein, forming beads at spaced intervals substantially along the entire length of container body adds significant structural strength to the container. As a result, the container is not readily deformed when in its un-pressurized state prior to being filled.

In fabricating the beads, they are made such that the outer surface of the can body has substantially the same outer diameter (O.D.) as the can body for a standard, non-beaded container. The minimum diameter of the can, indicated W in FIG. 2 is given by the formula $$\text{Minimum diameter} = O.D. - 2Z$$

That is, the outer diameter of the can body minus twice the depth of a bead.

To determine the strength or rigidity of the can in its un-pressurized condition, containers made in accordance with the above dimensions were subjected to a series of tests. It was found that when subjected to a force in excess of 10 lbs., there was little deflection in the sidewall of the can. During testing, it was found, for example, that an applied force of 13.7 pounds to the sidewall of the container produced a deflection of 0.098 inches (0.25 cm). Further, the can, when empty, was not easily crushed by hand. This is important because besides the cost savings realized by having a container requiring less material to fabricate than conventional, thicker walled containers, the beaded thin wall container of the present invention is not susceptible to damage during manufacturing operations performed prior to filling the container.

Figure 3:
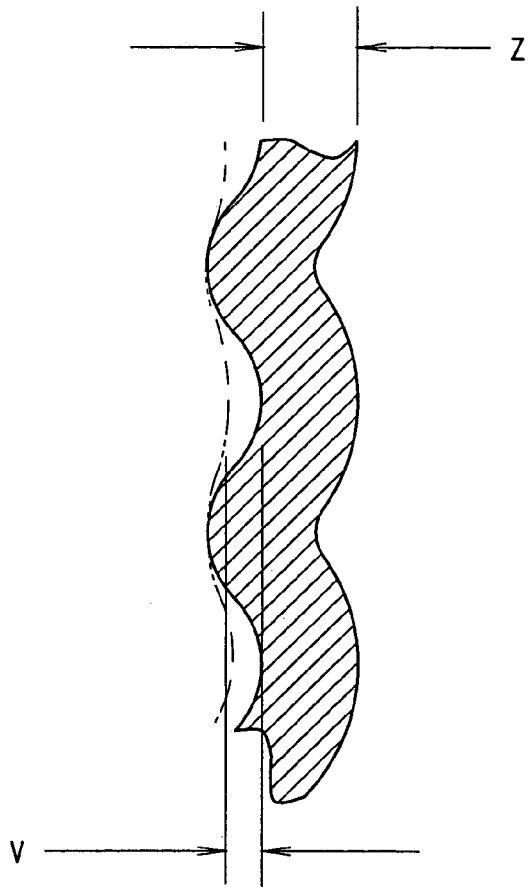
FIG. 3 is an enlarged partial sectional view of the sidewall of the container body illustrating the amount of deflection that occurs when the container is subjected to pressure; and, FIG. 4 is a partial sectional view of a 3-piece thin wall aerosol container.

The fluent material dispensed by aerosol container 10, and the propellant used for this purpose, are stored in the container under pressure. A two-piece aerosol container was constructed in accordance with the dimensions set forth above. During filling, it was found that the container could withstand a vacuum of at least 23 inches of Mercury without collapsing. In pressurization tests, container 10 was subjected to pressures ranging from 0-90 psi. Tests were then performed to measure how much the container expanded (both longitudinally, and diametrically). It will be appreciated, that as shown in FIG. 3, the internal pressure pushes outwardly on the container sidewall which tends to flatten the sidewall. For tests performed on a standard container of 202 size, the maximum distortion measured (indicated V in FIG. 3) was less than 0.0013 inches (0.33 mm).

What has been described is a thin wall aerosol container having a beaded sidewall construction. The beading adds sufficient strength to the container so that when un-pressurized, the can body is not readily distorted or crushed. This makes it less susceptible to damage during those manufacturing processes performed prior to filling the container. Further, when pressurized, the expansion of the can's sidewalls is minimal even at higher pressures. The container, when filled, can withstand vacuum levels in excess of 23 inches of Mercury without collapsing. When filled, the container will withstand extremely high internal pressures without bursting. Finally, aerosol containers made in accordance with the invention satisfy DOT regulations with respect to their ability not to distort when subjected to specified pressures at specified temperatures.

In view of the above, it will be seen that the several objects and advantages of the present invention have been achieved and other advantageous results have been obtained.

SEQUENCE LISTING

Not Applicable

Having thus described the invention, what is claimed and desired to be secured by Letters Patent is:

1. A large size aerosol container for dispensing a fluent material comprising:

a generally cylindrical beaded can body having a relatively thin sidewall thickness, the body having beads formed at spaced intervals along the length thereof, the beading adding structural strength to the container so the container cannot be damaged by handling during its manufacture, will not collapse during a vacuum filling, and cannot be crushed by hand before the container is filled;

a valve assembly for dispensing the fluent material stored in the container, the container being filled with the fluent material and a propellant therefor, the fluent material and propellant being stored in the container under pressure; and, the container body being formed of a sheet steel and having a sidewall thickness of between 0.004 inches (0.102 mm) and 0.010 inches (0.255).

2. The aerosol container of claim 1 wherein the valve assembly includes a spray valve for dispensing the fluent material, the valve assembly being attached to the can body at one end thereof.

3. The aerosol container of claim 2 further including a base attached to the other end of the can body.

4. The aerosol container of claim 1 which can withstand a vacuum of at least 23 inches of Mercury without collapsing.

5. The aerosol container of claim 4 in which the propellant is a compressed gas and the container pressure is between 90-140 psig (621-965 kPa) when filled.

6. The aerosol container of claim 4 in which the propellant is a liquefied gas and the container pressure is between 30-50 psig (207-345 kPa) when filled.

7. The aerosol container of claim 1 in which the can body has a plurality of beads formed therein, the beads being uniformly spaced along the length of the can body.

8. The aerosol container of claim 7 in which the uppermost bead formed in the can body and the lowermost bead formed therein are each formed the same predetermined distance from the respective upper and lower ends of the can body.

9. The aerosol container of claim 1 in which the depth of each bead is approximately one-sixth the distance between the center of adjacent beads.

10. The aerosol container of claim 1 in which at least the beaded can body is formed of a sheet steel having a weight range of between fifty to fifty-five pounds (50-55 lbs) per base box.

11. A large size aerosol container for dispensing a fluent material comprising:

a generally cylindrical can body made of steel and having a sidewall thickness of between 0.004 inches (0.102 mm) and 0.010 inches (0.255 mm), the can body being a beaded can body having beads formed at uniform intervals substantially along the length of the can body, the beading adding structural strength to the container so the container cannot be damaged by handling during its manufacture, will not collapse during a vacuum filling, and cannot be crushed by hand before the container is filled; and, a valve assembly for dispensing the fluent material stored in the container, the container being filled with the fluent material and a propellant therefor which are stored in the container under pressure.

12. The aerosol container of claim 11 in which at least the beaded can body is formed of a sheet steel having a weight range of between fifty to fifty-five pounds (50-55 lbs) per base box.

13. The aerosol container of claim 11 which can withstand a vacuum of at least 23 inches of Mercury without collapsing.

14. The aerosol container of claim 13 in which the propellant is a compressed gas and the container pressure is between 90-140 psig (621-965 kPa) when filled.

15. The aerosol container of claim 14 in which the propellant is a liquefied gas and the container pressure is between 30-50 psig (207-345 kPa) when filled.

16. The aerosol container of claim 11 in which the uppermost bead formed in the can body and the lowermost bead formed therein are each formed the same predetermined distance from the respective upper and lower ends of the can body.

17. A process for dispensing a fluent material from a large aerosol container comprising:

forming an aerosol container having a generally cylindrical can body of a relatively thin sidewall thickness, the can body being a beaded can body having a plurality of beads formed at uniform intervals substantially the entire length of the can body, the beads adding structural strength to the container so the container cannot be damaged by handling during its manufacture, will not collapse during a vacuum filling, and cannot be crushed by hand before the container is filled, the can body being made of a sheet steel having a weight range of between fifty to fifty-five pounds (50-55 lbs) per base box and having a sidewall thickness of between 0.004 inches (0.102 mm) and 0.010 inches (0.255 mm);

fitting a valve assembly to one end of the can body, the other end of the can body being closed, the valve assembly including a spray valve for dispensing the fluent material; and, filling the container with the fluent material and a propellant for dispensing the fluent material, the fluent material and propellant being stored in the container under pressure.

18. The process of claim 17 in which the propellant is a compressed gas and the container pressure is 90-140 psig when the container is filled.

19. The process of claim 17 in which the propellant is a liquefied gas and the container pressure is between 30-50 psig (207-345 kPa) when the container is filled.

20. The process of claim 17 in which the aerosol container can withstand a vacuum of at least 23 inches of Mercury without collapsing.

21. The process of claim 17 in which the uppermost bead formed in the can body and the lowermost bead formed therein are each formed the same predetermined distance from the respective upper and lower ends of the can body.

* * * * *